US008407971B2

(12) United States Patent
Vahlkamp

(10) Patent No.: US 8,407,971 B2
(45) Date of Patent: Apr. 2, 2013

(54) PACKAGE FOR SUPPLYING STUDENT ROOMS AT AN EDUCATIONAL INSTITUTION AND ASSOCIATED METHOD OF USE

(75) Inventor: Christopher Vahlkamp, Saint Louis, MO (US)

(73) Assignee: Dorm-In-A-Box, LLC, St. Louis, MO (US)

( * ) Notice: Subject to any disclaimer, the term of this patent is extended or adjusted under 35 U.S.C. 154(b) by 257 days.

(21) Appl. No.: 12/837,294

(22) Filed: Jul. 15, 2010

(65) Prior Publication Data

US 2011/0114516 A1 May 19, 2011

Related U.S. Application Data

(60) Provisional application No. 61/226,154, filed on Jul. 16, 2009.

(51) Int. Cl.
*B65D 69/00* (2006.01)

(52) U.S. Cl. ..... 53/474; 53/171

(58) Field of Classification Search ..... 53/171, 53/474

See application file for complete search history.

(56) References Cited

U.S. PATENT DOCUMENTS

| | | | | |
|---|---|---|---|---|
| 2,630,951 | A * | 3/1953 | Slightam | 53/448 |
| 4,865,884 | A * | 9/1989 | Usami et al. | 427/256 |
| 5,385,438 | A * | 1/1995 | Fadaie | 414/810 |
| 5,553,442 | A * | 9/1996 | Fadaie | 53/445 |
| 7,451,584 | B2 * | 11/2008 | Schateikis et al. | 53/443 |
| 7,743,587 | B2 * | 6/2010 | Hagenbrock et al. | 53/445 |
| 2009/0026159 | A1 * | 1/2009 | Mazur et al. | 211/85.8 |

* cited by examiner

*Primary Examiner* — Hemant M Desai
(74) *Attorney, Agent, or Firm* — Thompson Coburn LLP

(57) ABSTRACT

A single package providing dormitory room supplies for at least one student at an institution of higher education and associated method of use is disclosed. This package includes at least one shipping container. Numerous internal containers can be located within the shipping container. Dormitory room supplies are then located within the shipping container and/or internal containers. The essential items included are classified into the following categories: linen, clothing, organizational, electrical or electronic, and kitchen items. The package can be used to supply one or more dormitory rooms with all the essentials needed or to provide extras, which are typically required but not strictly essential. The single package can also include a cargo container, in which multiple shipping containers are located, to supply multiple dormitory rooms. This cargo container can be transported on a ship and as the trailer or placed on a trailer of a semi-trailer truck.

14 Claims, 5 Drawing Sheets

PACKAGE FOR SUPPLYING STUDENT ROOMS AT AN EDUCATIONAL INSTITUTION AND ASSOCIATED METHOD OF USE

CROSS-REFERENCE AND PRIORITY CLAIM TO RELATED APPLICATION

This patent application claims priority to provisional U.S. patent application Ser. No. 61/226,154, filed Jul. 16, 2009, and entitled "Package for Supplying Student Rooms at an Educational Institution and Associated Method of Use", the entire disclosure of which is incorporated herein by reference.

BACKGROUND OF THE INVENTION

Heading off to college can be an exciting and emotional time in a young college-bound freshman's life. Students are often exhilarated to start the next phase of their lives and to finally leave the nest and be off on their own. Others are more trepid and anxiety-ridden at the prospect of moving away from family and being left to their own devices. Parents also have conflicting emotions: pride and joy, worry and anxiety, among others.

Yet, at the typical American university or college, freshmen and their families do not have time to adequately deal with these emotions, to spend a last day with their parents, or to relax and meet new college friends. Instead, there is typically a rush on moving day.

Students and their parents have to get their dorm rooms furnished and supplied with all the college essentials. New college freshmen are usually starting anew, needing to buy everything, including bedroom supplies (e.g., sheets and blankets), desk supplies (e.g., pens, pencils, highlighters, staplers and binder clips), shower supplies (e.g., shower sandals, shower caddy and towels), electrical and electronic supplies (e.g., surge protectors, lamps, USB flash drive and fans), and organizational supplies (e.g., desk caddies, laundry hampers and drawer organizers). This process is nothing short of: a hassle, a waste of time, a waste of money, a waste of gasoline, and a burden on the environment.

Moving day typically involves multiple trips back and forth to the car, van or moving truck to lug boxes and bags full of supplies into the dormitory building, up the elevator and into the dormitory room. Some choose to do the extent of their shopping beforehand, while others procrastinate and wait until moving day. Either way, multiple shopping trips are typically necessary, wasting a substantial number of hours in shopping and driving. In fact, at a typical Top-100 University, students and parents spend over 22,800 hours shopping and drive over 64,500 miles, wasting over 3,750 gallons of gasoline and 72,750 pounds of $CO_2$ emissions.

Under this traditional model, students and parents buy their essentials at a local store or national chain. The store in turn gets these goods from manufacturers, though often not until they have passed through one or more intermediaries. Furthermore, each individual item is usually wrapped in plastic or cellophane, or worse yet, plastic clamshells, which are incredibly difficult and frustrating to open. At an average Top-100 University, this individual packaging amounts to 14.4 tons of post-consumer waste, which is often not biodegradable, filling up our landfills. This along with the large amount of transportation needed places a substantial drain on the environment.

This model also substantially adds to cost with each entity along the supply chain taking a mark-up along with additional transportation, marketing and advertising costs. In fact, the essential supplies that a new college freshman must purchase can easily exceed $1,200. This cost is a burden on all students and families, who often forget to budget for such essentials. It is especially troubling for under-privileged and low-income families who do not have the financial wherewithal to make these purchases. Many students attend college through grants, scholarships, and student loans. Money is usually obtainable for living expenses; however, it is rare for this money to be disbursed in time for moving day. This provides a disadvantage and even embarrassment for low-income students who might not be able to purchase all the required essentials and be properly prepared for the start of the school year.

The present invention is directed to overcoming one or more of the problems set forth above.

SUMMARY OF THE INVENTION

The present invention relates to a single package used to supply one or more dormitory rooms with school essentials and extras, as well as a method of supplying one or more dormitory rooms with school essentials in a single package. The use of a single package containing school essentials reduces the hassle, the cost, the amount of shopping and driving required, and the impact on the environment of moving day. It also increases equality amongst students. Importantly, it also allows for the cost of college essentials to be bundled into the price of room and boarding.

In one aspect of the present invention there is a single package containing all the essentials needed by a new entering freshman for a college dorm room. The single package is a shipping container. Included in the container can be one or more electrical or electronic devices that students typically utilize. Illustrative, but nonlimiting, examples include: alarm clocks; portable music playing devices; CD players; surge protectors; extension cords; and flashlights. The package may also contain one or more of linen items. Illustrative, but nonlimiting, examples include: bed sheets; blankets; pillows; mattress pads; bath towels; hand towels; and washcloths.

Since dormitory rooms are typically small, with limited closet and drawer space, so that organizational and storage supplies are typically required. These organizational supplies can also be provided in the container. Illustrative, but nonlimiting, examples include: closet hangers; under bed storage units; sweater organizers; over-the-door hook racks; removable adhesive hooks; laundry hampers; travel duffels; bed risers; shower caddies; and security safes. In addition, one or more of the basic kitchen items can be provided. Illustrative, but nonlimiting, examples include: a broom and dustpan; dishes; bowls; mugs; glasses; eating utensils; kitchen towels; a can and bottle opener; a blender; and a microwave. The container can also include other extras. Illustrative, but nonlimiting, examples include: a tool kit; a first aid kit; a sewing kit; or a deck of playing cards.

Another aspect of the invention relates to a single package containing all what is typically deemed an essential item for a student's desk in a college dormitory room. The single package is a shipping container. The shipping container includes one or more of the basic writing tools that most students would typically utilize. Illustrative, but nonlimiting, examples include: pens; pencils; markers; crayons; highlighters; or paintbrushes. Also included is one or more of certain electrical or electronic devices that most students require for their desks. Illustrative, but nonlimiting, examples of these devices that may be provided are: a computer flash drive; an external hard drive; an Ethernet cable; a USB vacuum; a lamp; a calculator; a fan; or a night light. Finally, organizational items help keep everything stored and organized. Illustrative, but nonlimiting, examples include: a trash can; a dry-erase board; a chalk board; an organizer caddy; a drawer organizer caddy; a ruler; a pad of sticky notes; a stapler; staples; scissors; push-pins; rubber bands; paper-clips; binder clips; and glue.

In yet another aspect of the invention there is a single package used to provide an entering college freshman with extra supplies that one would typically desire but that are not strictly essential. This package also includes a shipping container. Illustrative, but nonlimiting, examples include: clothing supplies; electrical or electronic devices; and organizational items. Illustrative, but nonlimiting, examples of clothing items include: bathrobes; flip-flops; shower sandals; and shower caps. Illustrative, but nonlimiting, examples of electrical or electronic devices include: shower radios; portable music playing devices; CD players; reading lights; lamps; and electric fans. Finally, illustrative, but nonlimiting, examples of organizational items could include: a laundry bag; a crate for storage; a CD holder; a DVD holder; or any other organizational or storage item.

In still yet another aspect of the invention, a single package can be used to supply not just one room but the dormitory room for each and every student in a building or even for all student rooms on campus. In this aspect, the single package includes a cargo container. In this cargo container are multiple shipping containers. These shipping containers are the same as the packages in previous aspects of the invention. The shipping containers contain all of the items used to supply a student's dorm room. Each student or dormitory room can then be provided with one or more shipping containers used to furnish and supply the room.

In all the above aspects of the invention, in order to be ecologically friendly, the one or more shipping containers can be reusable and/or recyclable or biodegradable. The shipping containers in some instances are reusable plastic containers that after shipment can be used for storage. Preferably, the shipping containers are a material such as cardboard, which can be recycled and disposed of after shipment. In some instances, the supplies included in the containers, such as the kitchen, organizational, electrical or electronic, writing, linen and clothing items preferably, have no individual wrapping or a very limited amount of individual wrapping. Instead, the items can be placed within a number of smaller recyclable boxes and/or reusable containers or bags. These containers can be made of a number of materials, including cardboard or plastic. The cargo container is a reusable container, which can be transported on a ship and as the trailer or placed on a trailer of a semi-trailer truck.

Another aspect of the invention relates to a method for providing college essentials and extras for the dorm room of a new entering college freshman. This method includes delivering a package, which is a shipping container containing supplies for a dormitory room from a single warehouse to an entity, which manages housing for students. The package can then be taken to the student's room and even be ready for the student before he or she moves in. Alternatively, the student can pick-up the package from the school, and unload it after taking it to his or her dorm room.

Finally, another aspect of the invention relates to a method for supplying multiple dormitory rooms, preferably for all student housing on campus. In this aspect, there is cargo container, which includes multiple shipping containers. Each shipping container contains supplies for a student's room. This aspect involves obtaining the cargo container, with its shipping containers and supplies, from a single warehouse location. This location can be in the United States or preferably overseas. The cargo container can be transported on a ship or placed on a trailer of a semi-trailer truck. This way, the cargo container only needs to be packed and unpacked one time each, saving time, resources and money. Moreover, preferably the cargo container used on a ship actually functions as the trailer for a semi-trailer truck.

These are merely some of the innumerable aspects of the present invention and should not be deemed an all-inclusive listing of the innumerable aspects associated with the present invention. The above description refers to college freshmen and college dormitory rooms; however, the invention can equally apply to any other level of education, such as boarding school, and is not limited to the college or university level. The invention can also be used for non-entering students, who are simply moving to a new room or just need their supplies replenished.

BRIEF DESCRIPTION OF THE DRAWINGS

In the drawings, which are not necessarily drawn to scale or with correct proportions, like numerals describe substantially similar components throughout the several views. The drawings illustrate generally, by way of example, but not by way of limitation, various embodiments discussed in the present document.

DETAILED DESCRIPTION OF THE INVENTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be used, or structural and logical changes may be made without departing from the scope of the present invention. The following detailed description is, therefore, not to be taken in a limiting sense, and the scope of the present invention is defined by the appended claims and their equivalents. In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
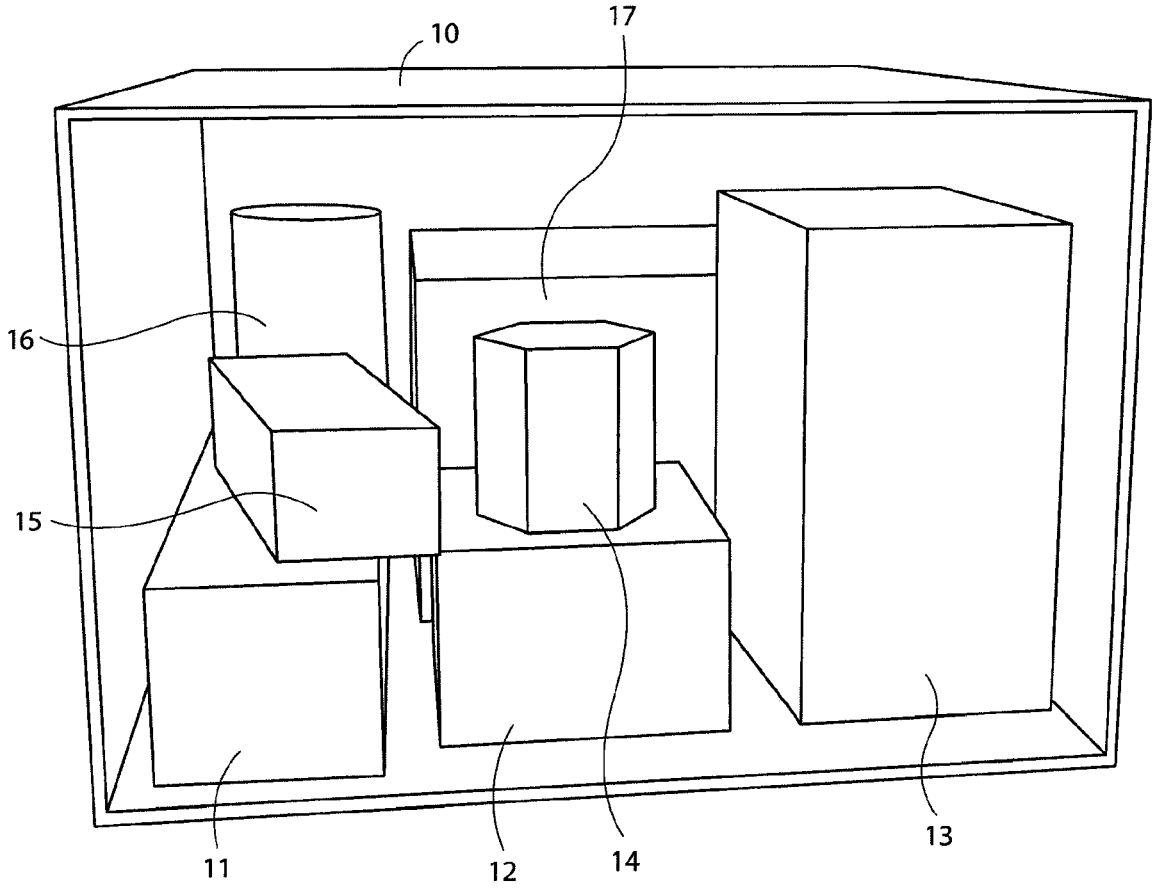
FIG. 1 is a three-dimensional side perspective view of a single package containing essentials needed to supply a student's dormitory room as provided in some embodiments of the present invention; the side wall has been removed so that the internal components are visible.
Figure 2:
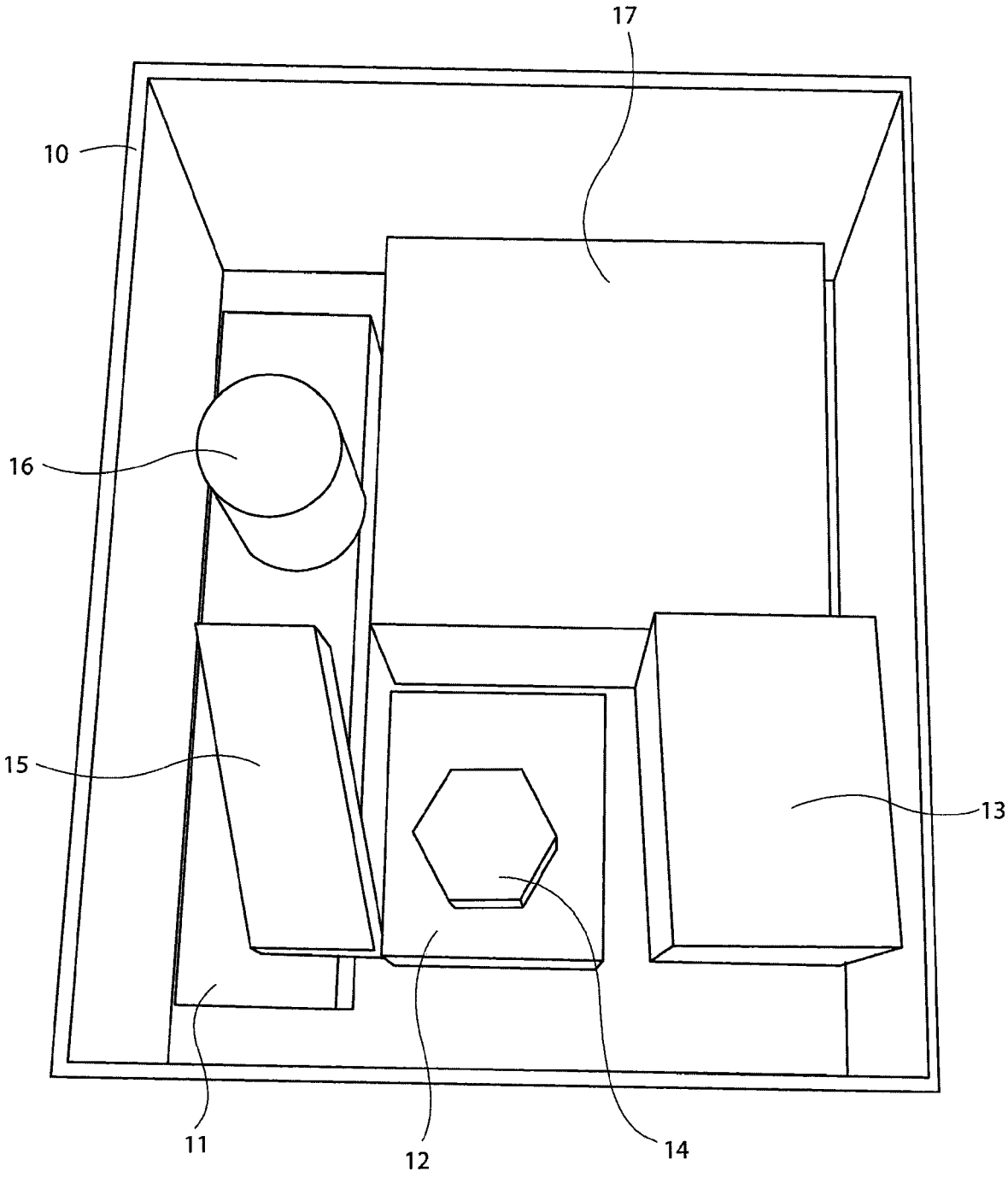
FIG. 2 is a three-dimensional top perspective view of the same single package shown in FIG. 1; the top wall has been removed so that the internal components are visible.

Referring now to FIGS. 1 and 2, which illustrate an exemplary embodiment of the present invention wherein there is a package, forming a shipping container, containing supplies used in a dormitory room of an entering college freshman, which is generally indicated by numeral 10. FIG. 1 shows a side perspective view of this package. The sidewall facing the viewer has been removed for purposes of this illustration so that the internal components 11, 12, 13, 14, 15, 16 and 17 are visible. The shipping container 10 can be made of various materials. In an illustrative embodiment, the shipping container 10 is reusable, and after being unloaded, can be used by the student in the dorm room as a storage container. In this embodiment, the shipping container 10 can be made of plastic or other suitable materials. A shipping container 10 that is reusable could have a lid, door, sliding drawer or other means to allow access to the internal portion of the shipping container 10 and allow it to be re-closed.

However, in the preferred embodiment, the shipping container 10 is recyclable. The shipping container 10 can be made of cardboard or other recyclable or biodegradable material, so that it can be easily disposed of after shipment in an ecologically friendly manner.

The shipping container 10 in FIG. 1 is depicted as a rectangular prism. However, the shipping container 10 is not limited to this shape. Any suitable shape for shipment can be used, such as any n-side prism, a cylindrical container, or any other shape.

Within the shipping container 10 of FIG. 1 are internal containers 11, 12, 13, 14, 15, 16 and 17. These internal containers 11, 12, 13, 14, 15, 16 and 17 hold the supplies that can be used in a dormitory room. The internal containers 11, 12, 13, 14, 15, 16 and 17 can also be recyclable and/or reusable similarly as described before with the shipment container 10. The internal containers 11, 12, 13, 14, 15, 16 and 17 are not limited to rectangular prisms. In fact, they can be of any suitable shape. Some embodiments will use one or more small recyclable cardboard boxes and plastic bags, preferably re-sealable ones, or a combination of both.

In FIG. 1, there are seven internal containers 11, 12, 13, 14, 15, 16 and 17 illustrated. However, this is only one example. The invention is not limited to seven internal containers; it may have more or less, even including none. The internal containers 11, 12, 13, 14, 15, 16 and 17 are used to store the student supplies in a way to use as little individual packaging as possible. Some items may be able to be simply placed into the shipping container 10 without any packaging. It is typical that like items will be grouped together and placed into internal containers. Some items, especially those that are fragile, will require some individual packaging to prevent breakage. However, it is preferred to limit the amount of packaging required in order to be ecologically friendly. It is anticipated that through this invention, the freshman class of a typical Top-100 University can save over 28,750 pounds of packaging that would otherwise be wasted.

FIG. 2 simply shows the exemplary embodiment depicted in FIG. 1 from a different angle. FIG. 2 is a top perspective view. In this drawing, the top wall facing the viewer has been removed from the shipping container 10 so that the internal containers 11, 12, 13, 14, 15, 16 and 17 are visible. The arrangement of the internal containers 11, 12, 13, 14, 15, 16 and 17 is for illustration purposes only. In fact, it would be more efficient to arrange the shipping container 10 and internal containers 11, 12, 13, 14, 15, 16 and 17 to eliminate all gaps and empty spaces. Such would have the advantage of eliminating the use of excess material, and would be beneficial in transportation, since the internal containers 11, 12, 13, 14, 15, 16 and 17 and items within would be less likely to move about in transit and be damaged.

Figure 3:
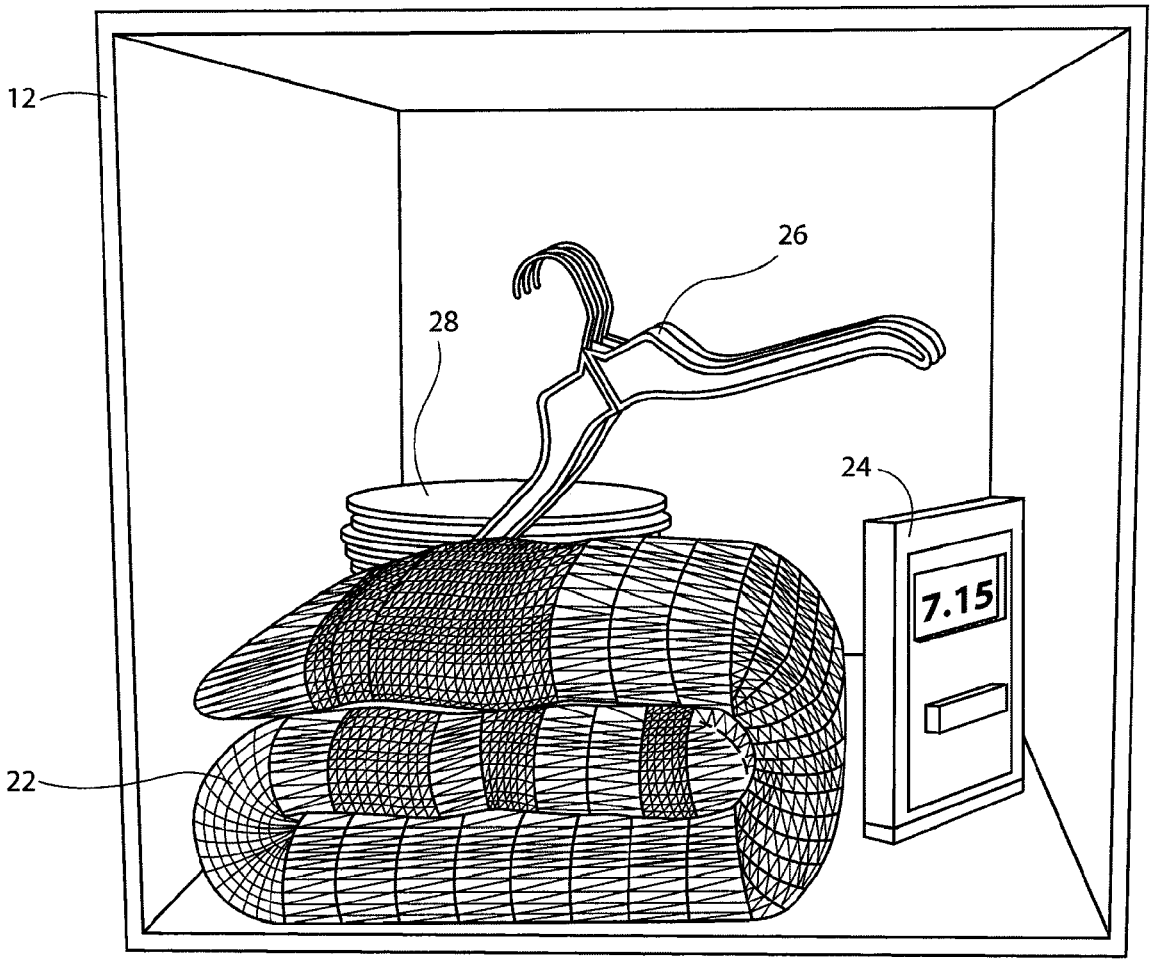
FIG. 3 is a perspective view of a component of FIGS. 1 and 2, showing an internal container that holds the items used to supply a college dormitory room that are a part of some embodiments; the side wall has been removed so that internal items are visible.

FIG. 3 illustrates a blown-up side perspective view of the internal container 12 after it is removed from the shipment container 10. As with FIG. 1, the sidewall facing the viewer has been removed so that the internal items are visible. The internal items are the supplies that a student typically needs. FIGS. 1-3 merely depict one illustrative, but nonlimiting, example of the present invention.

In this embodiment, the internal container 12 contains supplies needed to supply a student's living quarter, e.g., new entering college freshman's dorm room. These supplies can be broken down into different categories. One category is linen items 22. Linen item 22 depicts a blanket. However, this is for illustration purposes only. One or more of any linen item could be included in this embodiment. Other illustrative, but nonlimiting, examples of linen items include: bed sheets; pillows; mattress pads; bath towels; hand towels; and washcloths. Any other linen items needed by a student, e.g., new college dormitory freshman, may include, but are not limited to: drapes; pillow shams; or comforters.

A student, e.g., college freshman, is also going to utilize a variety of electrical or electronic items. This is depicted in FIG. 3 by the electrical or electronic item 24. Item 24 depicts a digital alarm clock for illustration purposes. One or more electrical or electronic items could be included in the shipping container. Illustrative, but nonlimiting, examples include: a portable music playing device; surge protectors; extension cords; and flashlights. Portable music playing devices can include, but are not limited to, portable MP3 players (and other digital formats), portable CD or tape cassette players, or other future technology. Any other electrical or electronic item that a college student uses could also be included. Other possible illustrative, but nonlimiting, examples include: CD players; computer flash drives (e.g., USB or other technologies); external hard drives (e.g., USB, FireWire, or other technologies); Ethernet cables; a USB vacuum for the keyboard; lamps used on a nightstand or on a desk; calculators; electric fans; or night lights.

Typically, student rooms, e.g., college dormitory rooms, do not have kitchens, and students instead go to the dorm cafeteria or restaurants. However, it is quite common for a college student to eat in his or her room on occasion. In fact, many students buy microwaves or even mini-refrigerators. Therefore, it is essential that every entering students, e.g., college freshman, have some basic kitchen items. Accordingly, the internal container 12 in this example contains one or more such kitchen items 28. Item 28 depicts a set of plates. However, this is for illustration purposes only. Illustrative, but nonlimiting, examples of kitchen items include: a broom and dustpan; dishes; bowls; mugs; glasses; forks; knives and spoons; and a can and bottle opener. However, any kitchen item that college students often use could be provided, including kitchen towels; chopsticks; a blender; a microwave; or even a mini-refrigerator.

Dormitory rooms are notoriously known to be small. There is often very limited closet and shelf space. It is very important for a student to have organizational items. Accordingly, such an organizational item 26 is included in the internal container 12. Item 26 depicts a set of closet hangers; however, this is only for illustrational purposes. Preferably, but not necessarily, the following organizational items could be included: wood closet hangers; an under bed storage unit; a sweater organizer; over-the-door hook racks; removable adhesive hooks; a laundry hamper; a travel duffel; bed risers; a shower caddy; and a security safe. Any other organizational item could also be included: a trash can; a dry-erase board; a chalk board; an desk organizer caddy; a drawer organizer caddy; a ruler; a pad of sticky notes; a stapler; staples; scissors; push-pins; rubber bands; paper-clips; binder clips; or glue.

The shipping container 10 may also contain other additional items. Illustrative, but nonlimiting, examples may include: a tool kit; a first aid kit; a sewing kit; and a deck of playing cards.

It is also important to note that not all of the items, i.e., kitchen, linen, electrical or electronic, organizational items, and/or additional items, have to be provided in the same internal containers, e.g., 11, 12, 13, 14, 15, 16 and 17, shown in FIGS. 1 and 2. These items can be placed into any of the internal containers 11, 12, 13, 14, 15, 16 and 17 or even directly into the shipping container 10. The arrangement would depend upon the size, shape, material and fragility of the items, as like items should be placed together for efficiency.

A second embodiment of the present invention is a package that contains all the essentials needed for the desk in a college freshman's dorm room. This embodiment is essentially the same as the embodiment depicted in FIGS. 1 and 2. However, the items are writing, electrical or electronic, and organizational items found in internal containers 11, 12, 13, 14, 15, 16 and 17.

The electrical or electronic and organizational items in this embodiment can be the same as described above in reference to the first preferred embodiment. However, illustrative, but nonlimiting, examples of electrical or electronic items include, but are not limited to: a computer flash drive; an external hard drive; an Ethernet cable; a USB vacuum for a keyboard; a desk lamp; a calculator; a fan; and a night light. The illustrative, but nonlimiting, preferred organizational items can include: a trash can; a dry-erase board; an organizer caddy; a drawer organizer caddy; a ruler; sticky notes; a stapler; staples; scissors; push-pins; rubber bands; paper-clips; and binder clips. The illustrative, but nonlimiting, preferred writing items can include any writing instrument used by a college student, including: pens; pencils; markers; crayons; highlighters; paintbrushes; and so forth.

In a third embodiment of the present invention there is a package used to provide an entering college freshman with extra supplies that students typically require but that are not deemed essential. This embodiment is essentially the same as the embodiment depicted in FIGS. 1 and 2. However, the items are clothing, electrical or electronic, and organizational items found in internal containers 11, 12, 13, 14, 15, 16 and 17.

The electrical or electronic and organizational items can be the same as in the first two embodiments. However, illustrative but nonlimiting, examples of the preferred electrical or electronic items provided are: a shower radio; a reading light; and a room fan. Illustrative, but nonlimiting, examples of organizational items may include: a laundry bag; a CD holder; and crates (preferably stackable mesh ones). The one or more clothing items could be anything a typical college student needs, with illustrative, but nonlimiting examples including: a bathrobe; flip-flops; or shower sandals. Other additional items could also be included, e.g., a water bottle.

Figure 4:
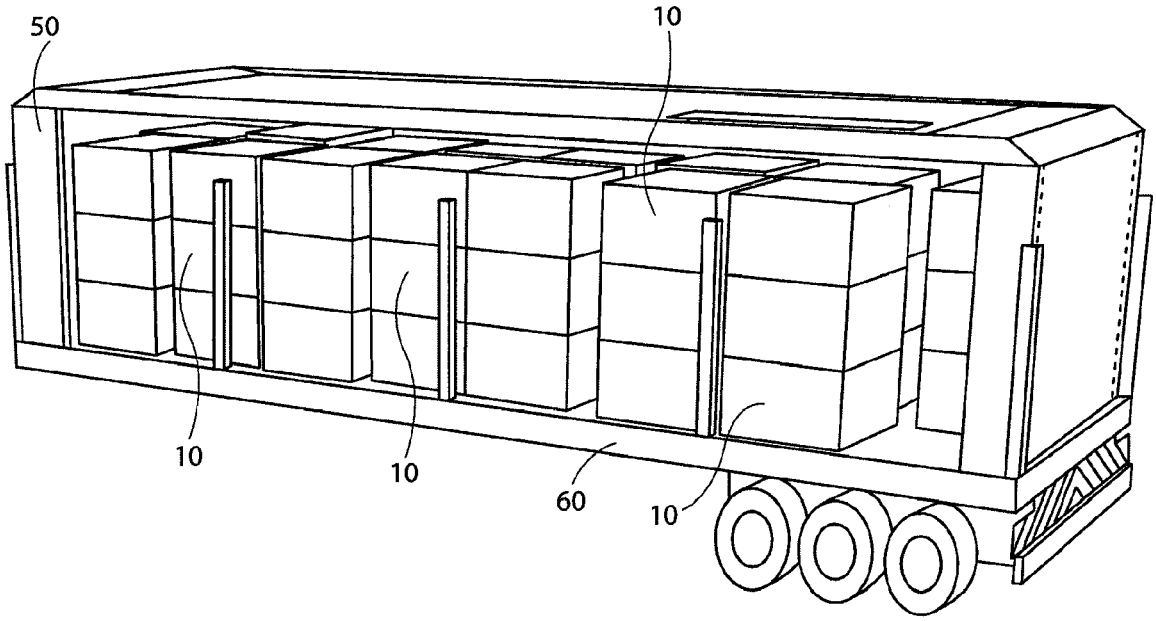
FIG. 4 is a side perspective view of a single package which is a cargo container such as a trailer for a semi-trailer truck containing multiple shipping containers that are used to supply multiple dormitory rooms as provided in some embodiments of the present invention; the side wall has been removed so that the shipping containers are visible.
Figure 5:
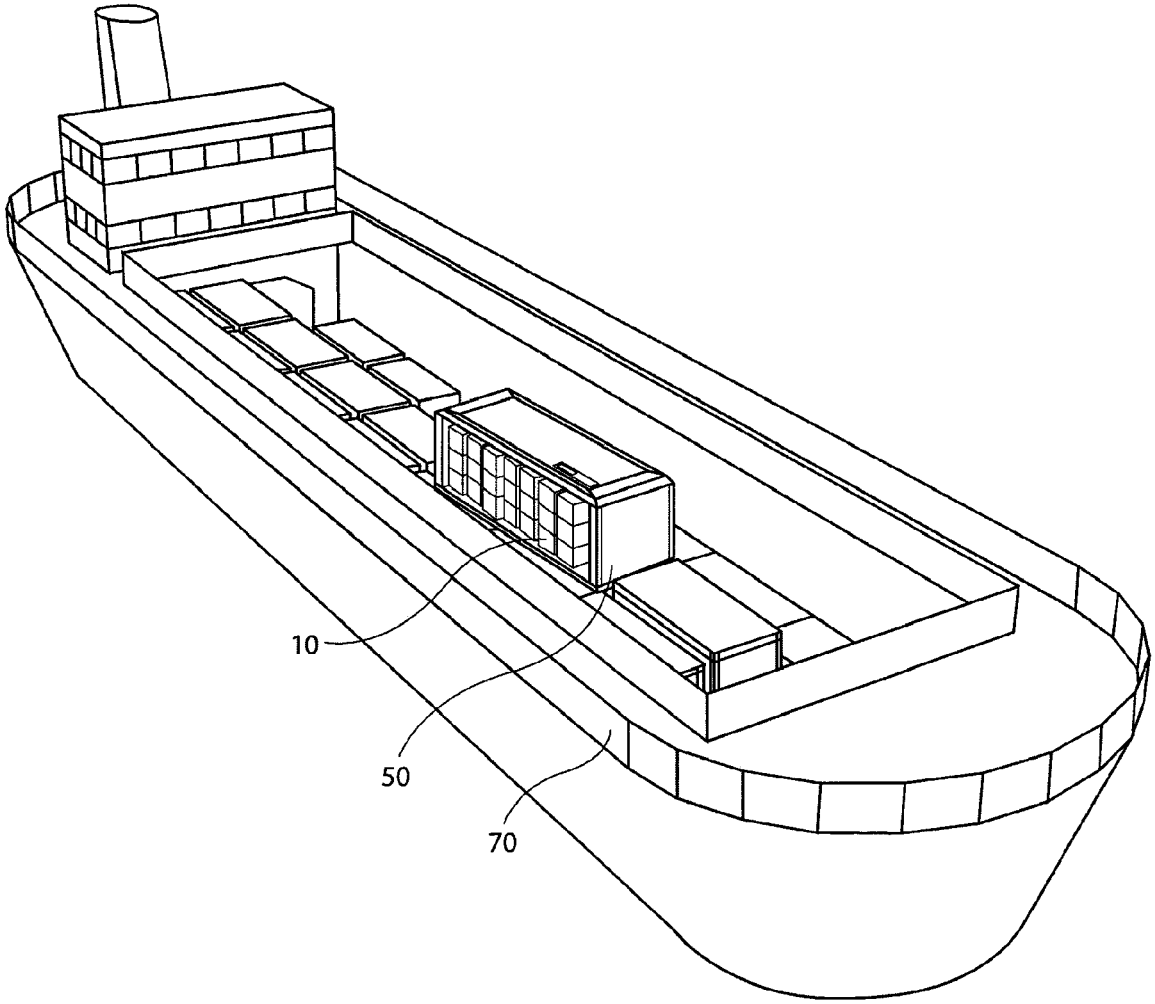
FIG. 5 is a side perspective view of a single package which is a cargo container containing multiple shipping containers that are used to supply multiple dormitory rooms, being transported on a ship as provided in some embodiments of the present invention; the side wall of the cargo container has been removed that the shipping containers are visible.

Referring now to FIGS. 4 and 5, which illustrate another exemplary embodiment of the present invention wherein there is a package, forming a cargo container 50, containing multiple shipping containers 10 that in turn contain supplies used in a dormitory room of an entering college freshman, which are generally indicated by numeral 10. This embodiment is used to supply multiple student rooms, preferably each and every room for student housing on campus. Each shipping container 10 contains the supplies needed for a student. In this way, a single package can be used to supply multiple dormitory rooms on a campus easily and efficiently.

Another preferred embodiment of the present invention relates to a method for use of the package embodiments. This method includes delivering the one or more shipping containers 10 containing supplies in internal containers 11, 12, 13, 14, 15, 16 and 17 for at least one student's room, e.g., dormitory room, from a single location or warehouse to an entity that manages housing for students of higher education. Preferably, the shipping containers 10 will be assembled at a single location or warehouse. By assembling the packages at a single location, excess intermediaries and packaging can be eliminated, along with excess transportation costs. This results in substantial cost savings and a lesser negative impact on an over-polluted world.

The one or more shipping containers will then be transported to an entity that manages student housing. Typically, this will involve transporting the shipping containers to the college or university nearby the dormitories. It is possible that at some schools, an entity other than the college owns and manages the dorm rooms, and in this case, the shipping containers will be delivered to that entity. This transportation can be done through the use of rail, trucks, mail, or other methods. Once the packages have arrived nearby the dormitories, a variety of methods can be used to take the packages to the appropriate dorm rooms. The organization providing the shipping containers 10 can arrange for them to be delivered completely to the dorm rooms. This can be done through the use of the organization's employees, temporary staffing, or a moving company. Alternatively, university employees or personnel can deliver the shipping containers 10 to the appropriate dormitory rooms.

Preferably, the one or more shipping containers 10 are assembled in a cargo container 50, as depicted in FIGS. 4 and 5. The package is assembled at a single location, which can be in the United States or overseas. The cargo container 50 can then be transported across water on a ship 70, and transported on land as a trailer 60 or placed on a trailer 60 of a semi-trailer truck. This method also saves time, resources, and excess transportation costs. It also allows the package to be packed only one time, at the single warehouse location, and then unpacked only one time, at the student housing location. FIG. 4 depicts the cargo container 50 on a flatbed semi-trailer 60 for illustration purposes. There are tremendous financial, environmental, and personal benefits associated with transporting a cargo container 50 directly to an educational institution. Moreover, this provides for the elimination of intermediaries including traditional warehouse, sales personnel, and other redundancies. However, the invention is not limited to this arrangement. The cargo container 50 could itself be the semi-trailer or it could be placed on any type of trailer, as one of ordinary skill in the art would recognize.

These methods allows for the shipping containers 10 and accompanying supplies to be waiting for the students when they arrive on moving day. The shipping containers 10 could also be unloaded and even set up for the students. This would eliminate a majority of the hassle, shopping trips, and wasted gasoline that are typically part of moving day for new college freshmen. It could also be arranged so that the students pick up the shipping containers 10 from elsewhere on campus and take them to their own rooms. This would not be as advantageous, but it would still be superior to the current timeconsuming, expensive, and environmentally detrimental process. It is believed that this will reduce the cost to students at a typical Top-100 University by $2.1 million annually or 65% from traditional retail prices.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "have," "having," "includes" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications, which do not depart from the spirit and scope of the invention, are deemed to be covered by the invention, which is limited only by the claims that follow. It should be understood that the embodiments disclosed herein include any and all combinations of features described in any of the dependent claims.

Furthermore, the above description of the drawings refers to college freshmen and college dorm rooms; however, the invention can equally apply to other levels of education, such as boarding school for elementary, middle or high school, and is not limited to the college or university level. The invention can also be used for non-entering students, who are simply moving to a new room, just need their supplies replenished, or living off-campus. One of ordinary skill in the art would further recognize that this invention could be equally adapted to furnish dormitory-like rooms at non-educational institutions, such as assisted living centers and nursing homes.

The invention claimed is:

1. A method for supplying at least one student's room at an educational institution, comprising:

placing at least one linen item housed within at least one first reusable container;

placing at least one electrical or electronic item housed within at least one second reusable container;

placing at least one organizational item housed within at least one third reusable container;

placing at least one kitchen item housed within at least one fourth reusable container;

assembling the at least one first reusable container, the at least one second reusable container, the at least one third reusable container and the at least one fourth reusable container in at least one shipping container at a single location; and transporting the at least one shipping container to an entity responsible for managing student housing at an educational institution.

2. The method for supplying at least one student's room at an educational institution according to claim 1, further comprising assembling the at least one shipping container in a cargo container at a single location; wherein the at least one shipping container includes a plurality of shipping containers.

3. The method for supplying at least one student's room at an educational institution according to claim 2, further comprising transporting the cargo container on a ship.

4. The method for supplying at least one student's room at an educational institution according to claim 2, further comprising transporting the cargo container as a trailer or placed on a trailer for a semi-trailer truck.

5. The method for supplying at least one student's room at an educational institution according to claim 1, further comprising:

placing at least one item from the group consisting of: a tool kit, a first aid kit, a sewing kit, and a deck of playing cards housed within at least one fifth reusable container; and assembling the at least one fifth reusable container within the at least one shipping container with the at least one first reusable container, the at least one second reusable container, the at least one third reusable container and the at least one fourth reusable container.

6. The method for supplying at least one student's room at an educational institution according to claim 1, wherein the at least one linen item is selected from the group consisting of: a set of bed sheets, a blanket, a pillow, a mattress pad, a bath towel, a hand towel, and a washcloth; and the at least one electrical or electronic item is selected from the group consisting of: an alarm clock, a portable music playing device, a CD player, a surge protector, an extension cord, and a flashlight; and the at least one organizational item is selected from the group consisting of: a closet hanger, an under bed storage unit, a sweater organizer, an over-the-door hook rack, a removable adhesive hook, a hamper, a travel duffel, a set of bed risers, a shower caddy, and a security safe; and the at least one kitchen item is selected from the group consisting of: a broom, a dustpan, a dish, a bowl, a mug, a glass, an eating utensil, a kitchen towel, a can opener, a bottle opener, a blender, and a microwave.

7. The method for supplying at least one student's room at an educational institution according to claim 1, further comprising moving the at least one shipping container into at least one student's room.

8. The method of claim 1, further comprising unloading the at least one shipping container before a student moves into the at least one student's room.

9. The method of claim 1, further comprising purchasing the at least one shipping container for each and every student at an educational institution regardless of economic background.

10. A method for supplying at least one student's room at an educational institution, comprising:

placing at least one writing item housed within at least one first reusable container;

placing at least one electrical or electronic item housed within at least one second reusable container;

placing at least one organizational item housed within at least one third reusable container;

assembling the at least one first reusable container, the at least one second reusable container, the at least one third reusable container in at least one shipping container at a single location; and transporting the shipping container to an entity responsible for managing student housing at an educational institution.

11. The method for supplying at least one student's room at an educational institution according to claim 10, further comprising assembling the at least one shipping container in a cargo container at a single location; wherein the at least one shipping container includes a plurality of shipping containers.

12. The method for supplying at least one student's room at an educational institution according to claim 10, further comprising transporting the cargo container on a ship.

13. The method for supplying at least one student's room at an educational institution according to claim 10, further comprising transporting the cargo container as a trailer or placed on a trailer for a semi-trailer truck.

14. The method for supplying at least one student's room at an educational institution according to claim 10, wherein the at least one writing item is selected from the group consisting of: a pen, a pencil, a marker, a crayon, a highlighter, and a paint brush; and the at least one electrical or electronic item is selected from the group consisting of: a computer flash drive, an external hard drive, an Ethernet cable, a USB vacuum, a lamp, a calculator, a fan, a night light, a shower radio, a portable music playing device, a CD player, and a reading light; and the at least one organizational item is selected from the group consisting of: a trash can, a dry-erase board, a chalk board, an organizer caddy, a drawer organizer caddy, a ruler, a pad of sticky notes, a stapler, staples, scissors, push-pins, rubber bands, paper-clips, binder clips, a container of glue, a laundry bag, a crate, a CD holder, and a DVD holder.

* * * * *